US006359968B1

(12) United States Patent
Harding

(10) Patent No.: US 6,359,968 B1
(45) **Date of Patent: *Mar. 19, 2002**

(54) X-RAY TUBE CAPABLE OF GENERATING AND FOCUSING BEAM ON A TARGET

(75) Inventor: Geoffrey Harding, Hamburg (DE)

(73) Assignee: U.S. Philips Corporation, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/501,895

(22) Filed: Feb. 10, 2000

(30) Foreign Application Priority Data

Feb. 12, 1999 (DE) ..... 199 05 802

(51) Int. Cl.[7] ..... H01J 35/08
(52) U.S. Cl. ..... 378/143; 378/125
(58) Field of Search ..... 378/143, 119, 378/125, 124

(56) References Cited

U.S. PATENT DOCUMENTS 3,525,228 A * 8/1970 Anderson ..... 378/143
4,723,262 A * 2/1988 Noda et al. ..... 378/143
4,953,191 A * 8/1990 Smither et al. ..... 378/143
5,052,034 A * 9/1991 Schuster ..... 378/143
5,157,704 A * 10/1992 Harding ..... 378/143
5,243,638 A * 9/1993 Wang et al. ..... 378/119
5,459,771 A * 10/1995 Richardson et al. ..... 378/143
5,577,091 A * 11/1996 Richardson et al. ..... 378/143
5,577,092 A * 11/1996 Kublak et al. ..... 378/143
5,991,360 A * 11/1999 Matsui et al. ..... 378/143
6,185,277 B1 * 2/2001 Harding ..... 378/143

FOREIGN PATENT DOCUMENTS

DE 19544203 6/1997 ..... H01J/35/08
EP 07772255a 6/1997 ..... H01J/35/08

OTHER PUBLICATIONS

"Design of a Mercury Vapor Target X–Ray Tube", by Bearden et al, The Review of Scientific Instruments, Dec. 1964, vol. 35, No. 12, pp. 1681–1683.

* cited by examiner

*Primary Examiner*—Drew Dunn

(57) ABSTRACT

The invention relates to an X-ray tube which includes a device for generating and focusing an electron beam on a target material. In order to avoid the problems of inadmissible heating of the anode while attempting to increase the electron beam density, according to the invention a gaseous target material contained in a chamber is used to generate the X-rays; this target material can be heated to a substantially higher temperature without the anode being damaged.

8 Claims, 1 Drawing Sheet

X-RAY TUBE CAPABLE OF GENERATING AND FOCUSING BEAM ON A TARGET

FIELD OF THE INVENTION

The invention relates to an X-ray tube which includes a device for generating and focusing an electron beam on a target.

BACKGROUND OF THE INVENTION

An X-ray tube of this kind is known, for example from DE 195 44 203. The electrons generated by an electron source (cathode) are accelerated in the direction of an anode in which they enter a conically constricted channel, the target being situated at the exit thereof. In this arrangement the electron beam is directed onto the target with a very small focus and a comparatively high electron density, so that X-rays are produced with a high efficiency.

This arrangement is in principle suitable for achieving a significant increase of the X-ray density (i.e. the number of photons emitted per unit of surface area of the target) in comparison with known X-ray tubes; however, such an increase is limited by the accompanying increase of the anode temperature. When this temperature reaches the range of the melting temperature of the anode material, the vapor pressure increases so that electric discharges could occur between the anode and the cathode.

Furthermore, the thermal conductivity of the anode decreases as the temperature increases. Consequently, the thermal conductivity of the electron focal spot in and through the anode material decreases and the temperature in the focal spot increases further, so that the melting temperature of the anode material is reached even faster and could be exceeded. This directly causes destruction of the anode surface. Therefore, it must be ensured that the focal spot temperature does not exceed a value of approximately 1500° C. in X-ray tubes of this kind, so that the theoretically possible further increase of the X-ray density must be dispensed with to a significant extent.

Because a reduction of the anode temperature by radiant cooling due to the electromagnetic emission from the anode is practically non-existent, the only possibility is either to cool the anode, for example by means of a cooling medium (inter alia water), or to rotate the anode continuously so that the relevant region in the electron focal spot is heated only for a comparatively short period of time, after which it is allowed to cool down again.

This step enables the focal spot temperature to be increased to approximately 2200° C. without the anode being damaged. Because the energy irradiated by thermal emission is proportional to the fourth power of the anode surface temperature, such rotary-anode tubes operate essentially with radiant cooling. The described steps, however, are either comparatively intricate or their effect is only limited.

SUMMARY OF THE INVENTION

Therefore, it is an object of the invention to provide an X-ray tube of the kind set forth whereby an essentially higher X-ray density can be achieved.

In an X-ray tube of this kind this object is achieved as described in claim 1 in that the target contains a material which is in the gaseous or vapor state at least in the operating condition of the X-ray tube and is contained under overpressure in a chamber which is at least partly permeable to electron radiation and X-rays.

If the target is then separated from the anode and substantially thermally insulated, the electron density in the focal spot of the electron beam can be significantly increased, so that a significantly higher X-ray density can be achieved without the anode temperature reaching inadmissibly high values.

The material contained in the chamber could be a noble gas having a sufficiently high atomic number, for example xenon which is gaseous in the operating condition as well as in the operating intervals. One embodiment describes the use of a heavy metal which may be solid or liquid in the operating intervals (i.e. at approximately room temperature) and is in a vapor state of aggregation in the operating condition (i.e. at comparatively high temperatures).

The entrance window offers the advantage that on the one hand the electrons passing through incur an energy loss of only approximately five percent, and that on the other hand the window is capable of withstanding pressure differences of up to 100 bar.

Another embodiment relates to coating the entrance window in conformity which offers the advantage that it will not be attacked and fogged by the high temperature plasma in the case of an unintentional increase of the operating pressure within the chamber.

The use of mercury in the quantity in another embodiment offers a particularly high efficiency.

BRIEF DESCRIPTION OF THE DRAWINGS

Further details, characteristics and advantages of the invention are apparent from and will be elucidated, by way of example, with reference to the preferred embodiment described hereinafter and with reference to the drawing. Therein.

DETAILED DESCRIPTION OF THE PREFERRED EMBODIMENTS

Figure 1:
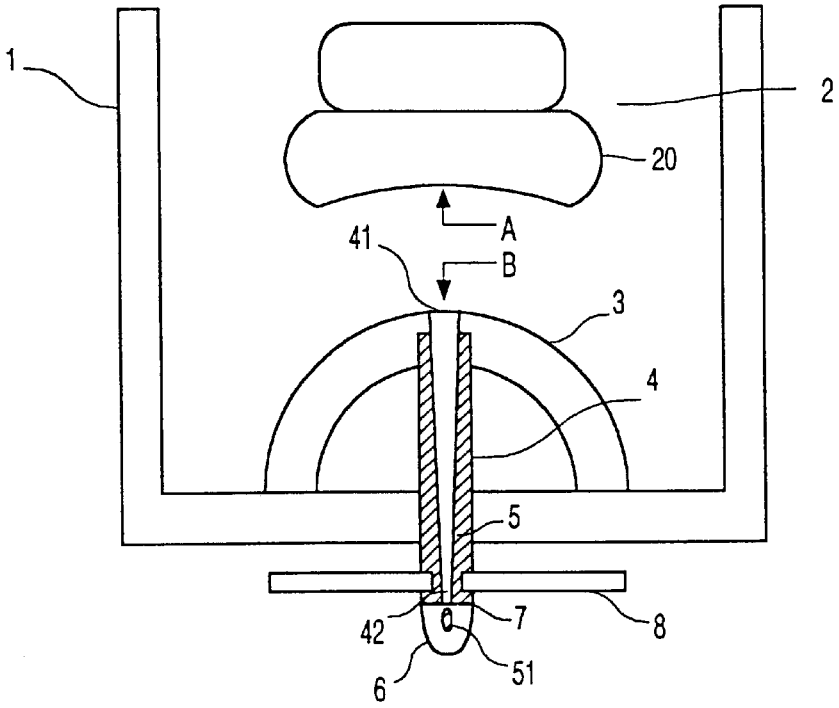
FIG. 1 is a diagrammatic cross-sectional view of such an embodiment.

The X-ray tube according to the invention is capable of achieving an essentially higher X-ray density, without the anode being heated to inadmissibly high temperatures. The heat produced in the chamber 6 is dissipated exclusively by radiant cooling.

The anode 3 is provided with a channel 4 with an entrance 41 for the electrons which is situated opposite the cathode 2. The exit 42 of the channel 4 faces a diamond window 7 of a chamber 6 which contains the target.

The entrance 41 of the channel 4 is larger than the exit 42. The channel is constricted in the direction of the exit (conical reduction) and is preferably arranged and constructed in such a manner that the electrons entering the channel are incident on a surface of the channel at an angle of no more than 1°. In that case the electrons are elastically reflected in the direction of the exit 42, without their incidence already generating X-rays and hence without significant energy losses being incurred. This also contributes to an enhanced efficiency of the X-ray tube, because electrons which contain a velocity component tangential to the filament of the cathode are scattered in the focal spot 51.

The diamond window 7 of the chamber 6 preferably has a free diameter of 1 mm and a thickness of approximately 10 $\mu$m. It is known (see the tables concerning the energy loss and the range of electrons and positions in M. J. Berger and S. M. Seltzer, NBS/NSS Report 39, 1964), that electrons with an energy of approximately 200 keV suffer an energy loss of only approximately 5% upon their passage through such a window. Because the diamond material furthermore has a low atomic number (Z=6), the electrons are scattered at very small angles only upon their passage through the window, so that the electron beam 5 enters the chamber 6 practically without having been influenced.

Finally, a cooling device 8 is arranged at the area of the exit 42 of the channel 4.

In the operating condition the cathode 2 emits electrons in known manner, which electrons are accelerated in the direction of the anode by the radial electrical field of the anode; they enter the channel 4 via the entrance 41. The channel 4 acts as a collimator and concentrates the electrons in the form of an electron beam 5 in a focal spot 51. The focal spot is situated within the chamber 6, so that the target material present therein (for example, mercury) evaporates and at the operating temperature of the X-ray tube the pressure in the chamber corresponds essentially to that in a high-pressure gas discharge lamp (approximately 50 bar).

The path length of the electrons in a mercury vapor at a pressure of 50 bar amounts to several millimeters. Thus, behind the diamond window there is formed a linear focal spot which has a length of approximately 5 mm in the propagation direction of the electrons and a width of approximately 2 mm in the direction perpendicular thereto.

The operating pressure within the chamber 6 should be optimized while taking into account the following limit values: when the pressure is too low, the electrons are diffused too far from the focal spot, so that the focal spot becomes comparatively large. On the other hand, when the pressure is too high, the inner side of the diamond window will be situated too close to the high-temperature plasma, so that it could be attacked thereby so that conversion into carbon takes place. The operating pressure, therefore, should lie between these two values. Additionally, the diamond window may also be coated with one or more thin metal layers of, for example titanium and/or platinum in order to achieve protection against the plasma.

Figure 2:
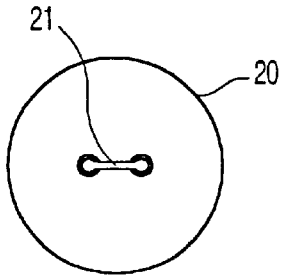
FIG. 2 is a view taken along the arrow A in FIG. 1.
Figure 3:
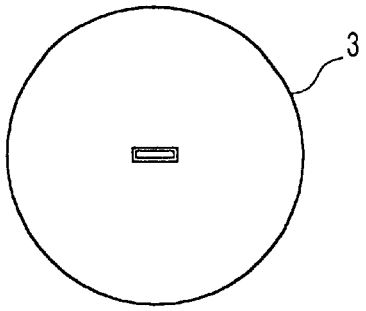
FIG. 3 is a view taken along the arrow B in FIG. 1.

FIG. 2 is a plan view of the cathode 2, taken along the arrow "A" in FIG. 1, and shows the actual filament 21. Finally, FIG. 3 is a plan view of the anode 3, taken along the arrow "B", the entrance 41 of the channel 4 being situated at the center of the anode.

The X-ray tube according to the invention is capable of achieving an essentially higher X-ray density, without the anode being heated to inadmissibly high temperatures. The heat produced in the chamber 6 is dissipated exclusively by radiant cooling.

What is claimed is:

1. An X-ray tube which includes a device for generating and focusing an electron beam on a target, characterized in that the target contains a material which is in the gaseous or vapor state at least in the operating condition of the X-ray tube and is contained under overpressure in a chamber (6) which is at least partly permeable to electron radiation and X-rays.

2. An X-ray tube as claimed in claim 1, characterized in that the target contains a heavy metal.

3. An X-ray tube as claimed in claim 2, characterized in that the heavy metal is mercury, the quantity of mercury being chosen to be such that it evaporates under the influence of the electron beam (5) and forms a gas with a pressure of approximately 50 bar.

4. An X-ray tube as claimed in claim 1, characterized in that the chamber (6) is made of quartz glass and includes an entrance window (7) of diamond for the electron beam (5).

5. An X-ray tube as claimed in claim 4, characterized in that the entrance window (7) has a thickness of approximately 10 $\mu$m and a diameter of approximately 10 mm.

6. An X-ray tube as claimed in claim 4, characterized in that the entrance window (7) is coated with at least one metal layer.

7. An X-ray tube as claimed in claim 6, characterized in that the metal layer contains titanium or platinum.

8. An X-ray tube as claimed in claim 1, characterized in that the device for generating and focusing an electron beam includes a cathode (2) and an anode (3) with a conical channel duct (4) whose entrance (41) facing the cathode is larger than its exit (42), which channel is arranged and constructed in such a manner that the electrons are incident on a surface of the channel (4) at an angle of no more than approximately 1 degree.

* * * * *